United States Patent [19]

Ohta et al.

[11] Patent Number: 4,925,425

[45] Date of Patent: May 15, 1990

[54] MOUTH STRUCTURE AND A SOUND GENERATING MEMBER FOR A DOLL

[76] Inventors: Shunsaku Ohta, 3-25-1, Nishi Asakusa Taitoku, Tokyo, Japan; Mon-Cheng Yeh, 2nd/F No. 36-1, Lane 150, Min Teh Road, Pei Toe, Taipei, Taiwan

[21] Appl. No.: 315,742

[22] Filed: Feb. 27, 1989

[51] Int. Cl.[5] ..... A63H 3/28

[52] U.S. Cl. ..... 446/185; 446/340

[58] Field of Search ..... 446/184, 183, 304, 339, 446/337, 340, 185

[56] References Cited

U.S. PATENT DOCUMENTS

| | | | |
|---|---|---|---|
| 3,005,283 | 10/1961 | Cohn | 446/340 X |
| 3,119,198 | 1/1964 | Ogata | 446/184 |
| 3,186,126 | 6/1965 | Ostrander | 446/303 X |
| 3,195,269 | 7/1965 | Weih et al. | 446/340 |

FOREIGN PATENT DOCUMENTS

| | | | |
|---|---|---|---|
| 1167346 | 11/1958 | France | 446/301 |

*Primary Examiner*—Mickey Yu

*Attorney, Agent, or Firm*—Lowe, Price, LeBlanc, Becker & Shur

[57] ABSTRACT

A sound generating toy adapted to emit a sound when the lower jaw is opened is described. The device includes an upper pressure plate which at its front portion mounts a head structure having a mouth and a lower pressure plate which has a front portion rotatably mounted on the upper plate and forming a lower jaw for the mouth structure. A sound emitting rubber sack is disposed between the two plates. When the plates are squeezed together, the lower jaw opens and a sound is emitted from the sack. When the pressure plates are released, the sack refills with air returning them to their original spaced apart relationship and closing the lower jaw against the mouth.

1 Claim, 4 Drawing Sheets

MOUTH STRUCTURE AND A SOUND GENERATING MEMBER FOR A DOLL

BACKGROUND OF THE INVENTION

Pet doll is a toy deeply loved by the children and young people. Fine and delicate pet doll is more than attractive to the children. In order to attract consumers to buy the toys, every manufacturer is making every endeavor to improve the formative design and to make use of any possible means to provide life-like sound and action.

The present invention is related to a design to let the mouth and the sound generating means of a toy be coupled together for synchronous action such that a sound is concomitantly provided to match with the closing or opening of the mouth. According to the present invention, the assembly of the whole structure is efficiently achieved without using any screws or other fastening means.

SUMMARY OF THE INVENTION

The present invention is to provide a mouth structure and a sound generating member for a toy and, more particularly to a toy which can automatically return to original reset position immediately after providing a sound, wherein a lower pressure plate comprised of lower jaw portion and abdomen portion is connected with an upper pressure plate comprised of neck portion and back portion and is further connected to a head figure housing of the toy by means of the hook flange of said neck portion to retain in the notch of said head figure housing; said upper pressure plate and lower pressure plate being arranged to define a space for setting therein of a sound generating sac to let said sound generating sac provide a sound and to let the toy open its mouth at the time said upper and lower pressure plates are pressed inward; and to let said sound generating sac suck air to force said upper and lower pressure plates return to original position and to let the toy close its mouth at the time the outer force is released from said upper and lower pressure plates.

In general, the present invention is to provide a sound generating toy having numerous features each of which tends to make the structure more practical and active.

For fuller understanding of the present invention, the embodiments of the present invention will now be described by way of example, reference being made to the accompanying drawings as hereunder.

DETAILED DESCRIPTION OF THE PREFERRED EMBODIMENT

Figure 1:
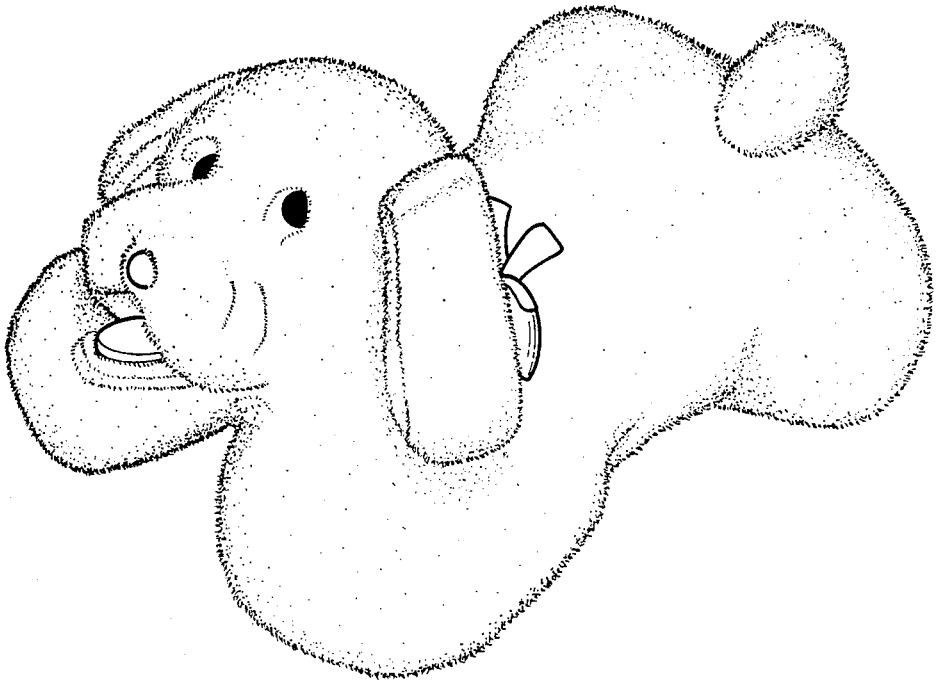
FIG. 1 illustrates the outer appearance of a sound generation toy constructed according to the present invention.
Figure 2:
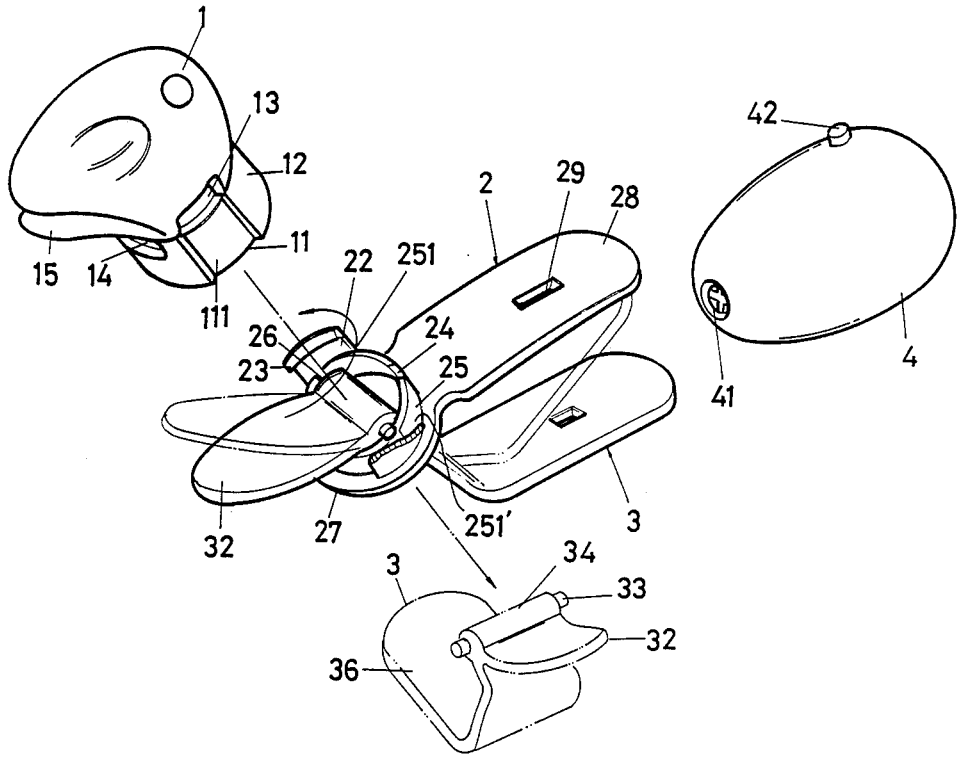
FIG. 2 is a fragmentary structural view drawing of the said preferred embodiment.

Referring to the fragmentary view drawing of FIG. 2, a sound generating toy includes a head figure housing (1) constructed according to preferred animal, having a circular protruding portion (15) comprising a hollow hole (14) arranged therebelow to define a mouth-like structure. There is provided a lower pressure plate (3) having a protruding protion (32) defined as for the lower jaw of the doll, being disposed below said head figure housing (1) to let the protruding lower jaw (32) protrude beyond the hollow hole (14) of said head figure housing (1).

The said head figure housing (1) comprises a connector ring (12) at the bottom having a curved notch (11) made thereon at both sides abjacent to said mouth (14). A hole (13) is made on the top of each notch (11) for connection of said head figure housing (1) with an upper pressure plate (2) by means of the hook (23) of said upper pressure plate (2) to retain the hole (13) of said head figure housing (1).

The said upper pressure plate (2) is the main frame of the present embodiment, comprised of a ring-shaped front base (27) and a circular rear clamping plate (28), wherein said ring-shaped front base (927) and said circular rear clamping plate (28) are integrally connected to define a curvature therebetween. Said ring-shaped front base (27) includes a circular protrusion (25) having one pair of symmetric scoop channels (24) thereon arranged along the axial direction of said upperr pressure plate (28), and tow longitudinal notches (26) respectively arranged at both sides in vertical to the axial direction for allocation thereon of the revolving axle (33) of said lower pressure plate (3) to let said lower pressure plate (3) be turnably attached to said upper pressure plate (2). When to connect said upper and lower pressure plates (2) and (3) to build up the assembly, the lower jaw (32) of said lower pressure plate (3) is inserted into the ring-shaped front base (27) of said upper pressure plate (2) letting the bilateral axles (33) be pushed upward along the symmetric scoop channels (24) to further be turned to set in the bilateral notches (26), so as to let said lower pressure plate (3) be turnably attached to said upper pressure plate (2).

Said upper pressure (2) further includes tow curved plates (22) bilaterally disposed at the outer side of the circular protrusion (25) to protrude upward. Both said curved plates (22) are specifically arranged to match with the respective notchs (11) of said head figure housing (1), comprising a hook-shaped flange (23) on the top. After said upper and lower pressure plates (2) and (3) are connected together, the curved plates (22) of said upper pressure plate (2) are respectively attached to the bilatertal notches (11) of said head figure housing (1), the hook-shape flange (23) of the tow curved plate (22) is retained in the respective hole (13), and the inner wall (111) of each notch (11) is set in the respective gap (251) defined by the curved plate (22) and the circular protrusion (25) such that said upper pressure plate (2), lower pressure plate (3) and head figure housing (1) are firmly connected together.

Figure 3:
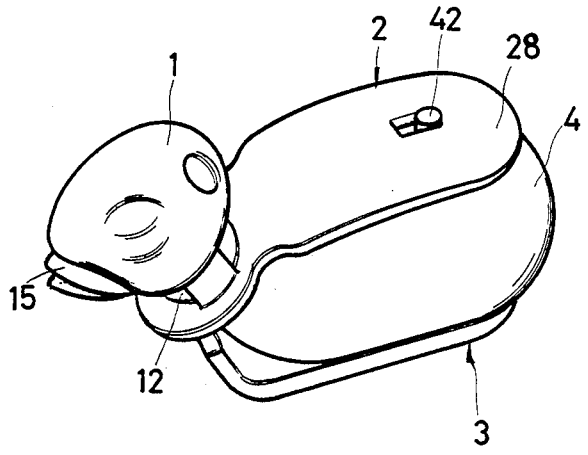
FIG. 3 is a perspective structural view of the said preferred embodiment.
Figure 4:
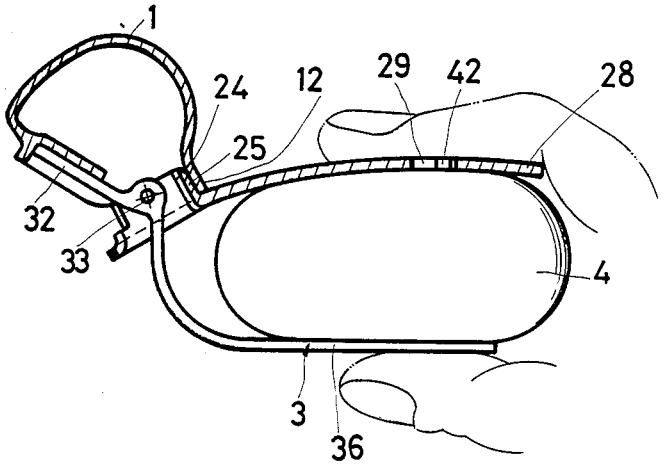
FIG. 4 is a sectional structural view drawing of the said preferred embodiment.
Figure 5A:
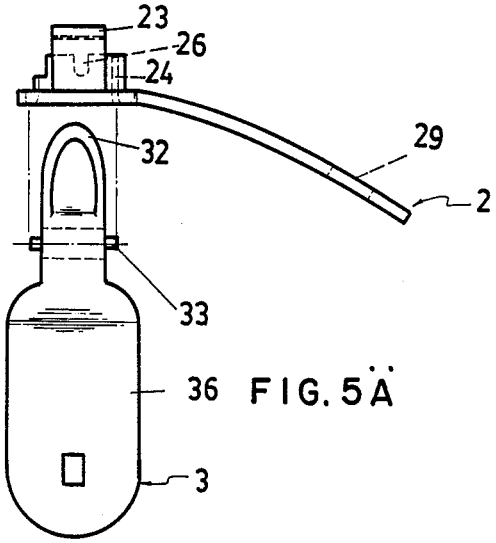
FIG. 5 illustrates the moving action to assemble the structure of the said preferred embodiment.
Figure 5B:
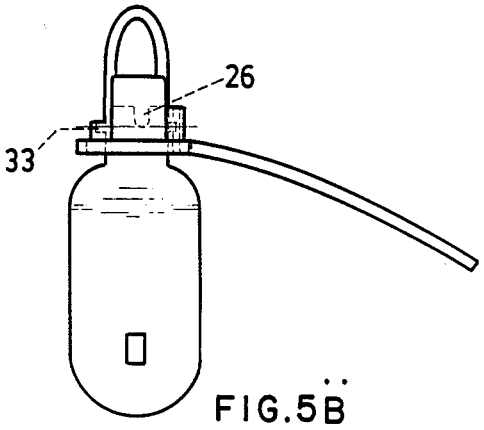
Figure 5C:
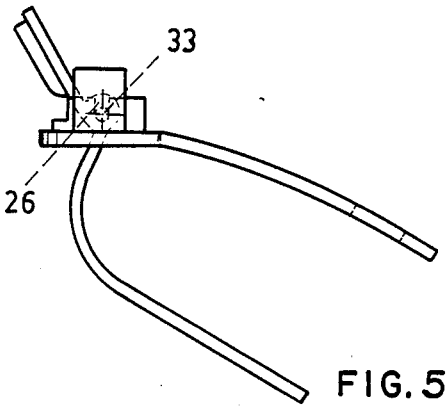

The said lower plate (3) is constructed according to double-curve design such that the backwardly elongated clamping elemant (36) is provided to match with the backwardly elongated clamping element (28) of said upper pressure plate (2) to form a clamping device for clamping a sound generating sac (4). Referring to FIG. 3, a sound generating sac (4) is set between tow clamping elements (36) and (28). When outer pressure is applied to press both clamping elements (36) and (28) inward, the inner air of said sound generating sac (4) is forced to blow out through a sound genereting hole (41)

to vibrate a sound genereting capsule to provied sound. At the same time, the lower jaw plate (32) of said lower pressure plate (3) is forced to rock downward on the basis of the axle (33), just like an animal to open its mouth. Because said soud generating sac (4) is made of rubber material which provides high elasticity, the sound generating sac (4) will suck up outer air to return to original inflated configuration immediately after outer force is released from the clamping elements (36) and (38), and the clamping elements (36) and (38) will concomitantly be forced to return to ready position for next operation. When the slamping elements (36) and (38) are pushed back to original position, the mouth is closed simultaneously. While the sound generating sac (4) is sucking sac (4) through the sound generating hole (41) and to vibrate the sound generating capsule to provide a sound again.

Further, according to the present invention, the said clamping elements (36) and (28) are respectively arranged to provide a square hole for insertion thereinto of the respective strut (42) made on both sides of the said sound generating sac (4) such that the said sound generating sac (4) is firmly retained by the said clamping elements (36) and (28) after it is set therein.

We claim:

1. A sound emitting doll with a mouth that opens to emit the sound and closes comprising:

a head figure having a circular protruding portion with a hole in the lower portion thereof to define a mouth-like structure and a depending connecting ring adjacent and behind the hole, the ring having opposed notches each extending upwardly toward said head figure and terminating in a slot extending across the notch;

an upper pressure plate having a ring-shaped front portion supporting the head figure and an elongated, pressure plate rear portion the plate having a centrally dispersed hole therethrough, the front portion mounting an upstanding circular flange which has opposed internal channels extending axially with said plate, each channel having a notch depending therefrom, the ring shaped front portion further having opposed, upwardly extending curved plates adapted to extend along the notches in said head figure and engage the slots therein;

a lower pressure plate having a protruding front portion defining the lower jaw of a doll and an elongated pressure plate rear portion the sides of the central portion immediately behind the front portion mounting laterally outwardly extending axles, each axle rotatably received in a respective channel notch in said upper plate flange so that front portion extends through the ring portion of said upper plate and is aligned with the mouthlike structure as the head figures lower jaw with said upper and lower pressure plates in spaced apart alignment when the lower jaw is closed against the mouthlike structure; and sound generating, resilient sack means disposed between said plates for emitting a sound when said plates are squeezed together and for expanding to return the plates to a spaced apart relationship when released.

* * * * *